US006663381B2

(12) United States Patent
Manohar

(10) Patent No.: US 6,663,381 B2
(45) Date of Patent: Dec. 16, 2003

(54) BURNER ARRANGEMENT FOR LOW NOX EMISSIONS

(75) Inventor: Shailesh Sharad Manohar, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 142 days.

(21) Appl. No.: 09/956,211

(22) Filed: Sep. 20, 2001

(65) Prior Publication Data

US 2003/0054305 A1 Mar. 20, 2003

(51) Int. Cl.[7] ..... F23M 3/04; F23M 3/02; F23D 11/44

(52) U.S. Cl. ..... 431/10; 431/8; 431/11; 431/166; 431/247; 126/116 R

(58) Field of Search ..... 431/8, 10, 11, 431/164, 166, 181, 187, 247, 351, 354; 126/116 R

(56) References Cited

U.S. PATENT DOCUMENTS

| | | | | | |
|---|---|---|---|---|---|
| 1,805,066 | A | * | 5/1931 | Andrieux | 431/8 |
| 2,124,764 | A | * | 7/1938 | Comstock | 148/626 |
| 3,918,834 | A | * | 11/1975 | Sigal et al. | 431/10 |
| 4,622,007 | A | * | 11/1986 | Gitman | 432/13 |
| 5,431,559 | A | * | 7/1995 | Taylor | 431/164 |
| 5,871,343 | A | * | 2/1999 | Baukal et al. | 431/10 |
| 6,089,855 | A | * | 7/2000 | Becker et al. | 431/9 |
| 6,283,747 | B1 | * | 9/2001 | Legiret et al. | 432/12 |

* cited by examiner

*Primary Examiner*—Alfred Basichas

(57) ABSTRACT

In a gas burner for introducing a fuel/air mixture into a combustion chamber, a tube is provided for introducing a source of primary air into a core portion of the fuel air mixture. The resulting secondary flame that is produced within the primary flame causes a reduction of NOX gases, which can be attributed to the dispersion of combustion byproducts within the primary flame. In one embodiment, the air supply tube enters the area of the fuel air mixture radially and then turns and extends axially along an extended axis of the burner.

13 Claims, 2 Drawing Sheets

BURNER ARRANGEMENT FOR LOW NOX EMISSIONS

BACKGROUND OF THE INVENTION

This invention relates generally to gas burners for residential furnaces and for commercial heating and cooling packaged products and, more particularly, to apparatus for reducing NOX emissions from such devices.

Continued concern about atmospheric pollution has created renewed interest in lowering the emissions of various combustion devices. Of particular concern are nitric oxide (NO) and nitrogen dioxide (NO2) emissions because of their roles in forming ground level smog and acid rain, and in depleting stratospheric ozone. For simplicity, NO and NO2 are often grouped together as NOx. Many jurisdictions have stringent NOx emissions regulations. For example, California limits NOx emissions from gas furnaces to a maximum of 40 ng/J. It is expected that over the coming years, the regulations will become more stringent.

The common mechanism for the formation of NOx in a gas fired furnace is referred to as thermal NOx. In this mechanism, high flame temperatures, generated by the combustion process, result in the formation of NOx. The primary strategy to control NOx formation is to lower the flame temperature. One method is shown in U.S. Pat. No. 4,904,179, wherein a radiant member is inserted in the flame. The member heats up, radiates energy away from the flame and thereby cools the flame down. The disadvantage of this method is that the NOx benefit gained will not be enough to meet possible future regulations. Another method to lower flame temperature is to recirculate flue gas into the flame. The presence of combustion products suppresses flame temperature. One method is achieving this, is described in a preferred embodiment of U.S. Pat. No. 6,071,115. High momentum secondary air jets are injected into the primary fuel-air mixture from the outside, thereby promoting mixing and causing a recirculation of the combustion products into the flame. However, it is difficult to apply this concept to a furnace in a simple, and cost-effective way.

It is therefore an object of the present invention to provide an improved apparatus and method for reducing NOx in a gas burner.

SUMMARY OF THE INVENTION

Briefly, in accordance with one aspect of the invention, a tube is inserted into the downstream area of a burner and air is supplied to one end of the tube and emerges at the other end thereof so as to thereby reduce the resulting generation of NOX.

By another aspect of the invention, the tube extends radially inwardly near the end of the burner and then turns to extend substantially along an extension of the burner axis, with the air being discharged at the end of the tube, the position of which is optimized to obtain a desired degree of NOX reduction while maintaining a low noise level.

In the drawing as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
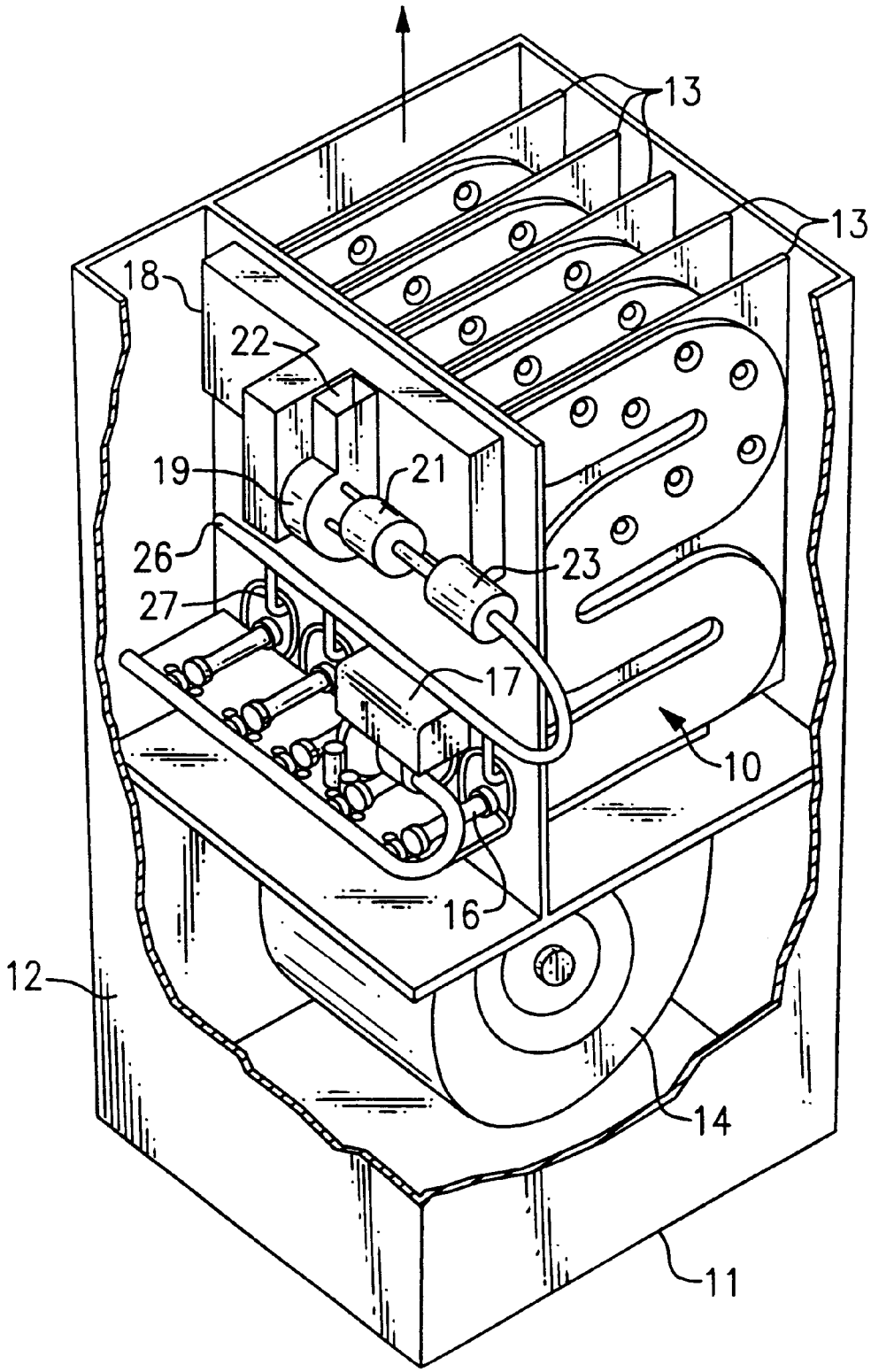
FIG. 1 is a perspective view of a furnace with the present invention incorporated therein.

Referring now to FIG. 1, the present invention is shown generally at 10 as applied to a typical hot air furnace 11 having a sheet metal covering 12 which encases a series of heat exchangers 13, an air circulation blower 14, a plurality of burners 16 and a pressure regulator 17. The burners 16 are so arranged that they receive gas from the pressure regulator 17 to be injected by the burners 16 into the open ends of the heat exchangers 13 for ignition. Secondary air is drawn through the heat exchangers 13 by way of a common header 18, which is fluidly connected to an inducer 19 driven by a motor 21. The exhaust gases are then discharged through a vent 22. The structure is all common to most induced draft furnaces.

In accordance with the present invention, additional apparatus is provided to enhance the combustion process by reducing NOX emissions. An air pump 23 is mounted adjacent the inducer drive motor 21 and is drivingly connected thereto by way of a driveshaft 24. The air pump 23 takes its suction from the ambient air adjacent the furnace and discharges to an air manifold 26 that passes along the burners 16 as shown. From the air manifold 26, the air is then routed to the fuel/air mixture of the individual burners 16 by way of air inlet conduits or tubes 27. This air is then applied to the fuel/air mixture of the burners 16 as a source of primary air for augmenting the combustion process for the purpose of reducing NOX in a manner to be described below.

Figure 2:
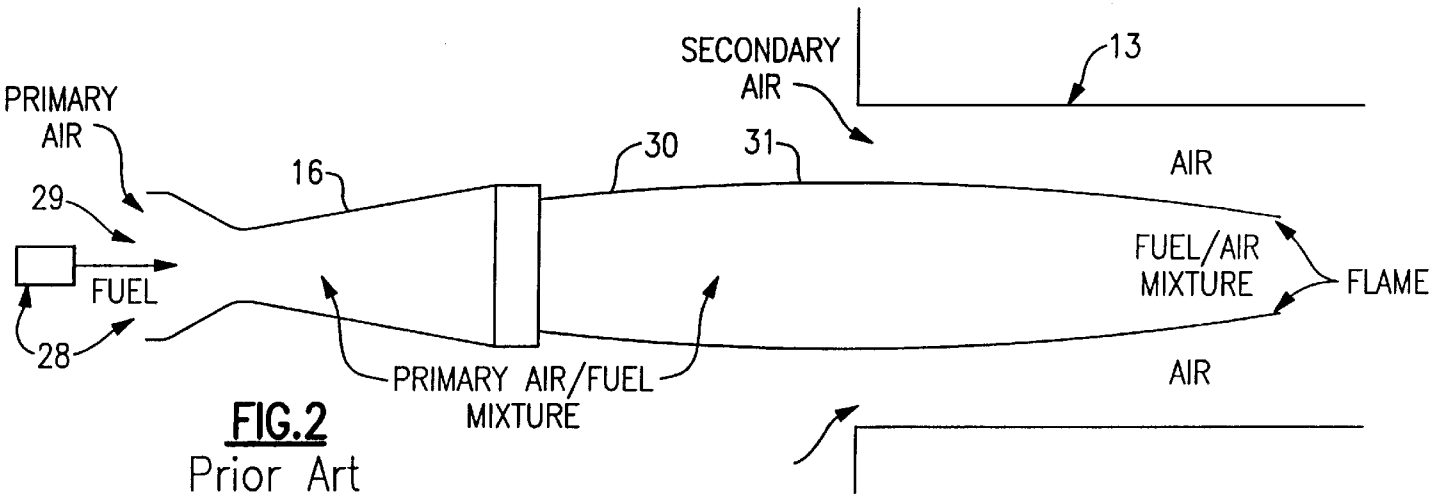
FIG.2 Prior Art
FIG. 2 is a schematic illustration of a gas burner and flame in accordance with the prior art.

Before examining the effect of the present invention, it may be well to review the combustion process in a conventional burner arrangement as shown in FIG. 2. As fuel from a fuel injection spud 28 is introduced into the inlet 29 of a burner 16, primary air is drawn into the inlet 29 as indicated by the arrows. This primary air/fuel mixture passes through the burner 16 and into the area downstream thereof where secondary air is introduced as indicated by the arrows. At the boundary 30 between the primary air/fuel mixture and the secondary air, combustion occurs and a primary flame 31 results.

Figure 3:
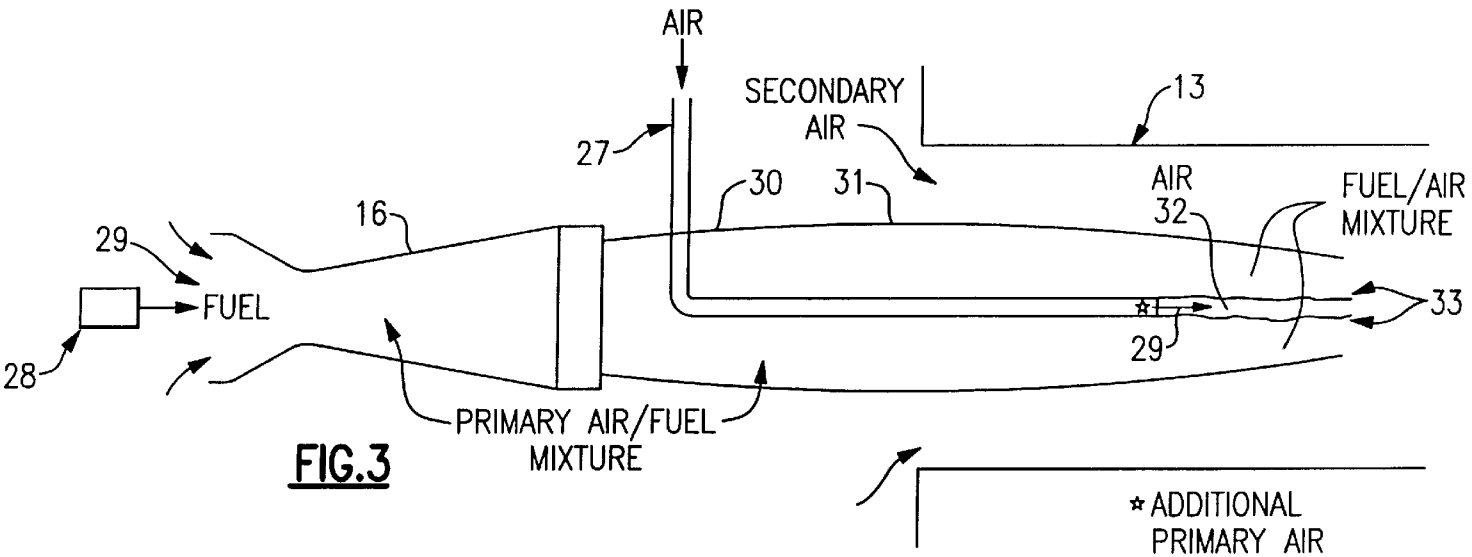
FIG. 3 is a schematic illustration of a gas burner and flame in accordance with the present invention.

Referring now to the present invention as shown in FIG. 3, a burner 16 is shown along with its air inlet tube 27 which projects radially inwardly into the primary air/fuel mixture or the flame and then turns to extend along an extension of the centerline of the burner, to remain within the flame throughout its length. From its open end 29, primary air from the air pump 23 is discharged into the fuel/air mixture to thereby enhance the burning process and reduce the production of NOX gases. The length of the tubes 27 can be varied in order to meet specific performance requirements. In this regard, it is recognized that shorter tubes tend to provide for greater NOX reductions, but will produce greater noise levels. Thus, these parameters may be optimized by experimenting with various lengths of tubes.

The theory of NOX reduction by the introduction of primary air into the internal portion of the flame as described above can be explained by reference to FIGS. 2 and 3. In the conventional burner arrangement of FIG. 2, the combustion which occurs produces a relatively high temperature primary flame 31 and relatively high NOX levels. In the case of the present invention as shown in FIG. 3, where primary air is introduced into the heart, or core, of the primary flame 31 as shown on the right side of the figure, there is again a boundary 32 wherein the fuel/air and air (and in this case, it is primary air) interact to produce combustion and a secondary flame 33. However, in this case the secondary flame 33 is internal to the primary flame 31, thereby producing combustion byproducts within the primary flame 31. These combustion byproducts are dispersed within the primary flame, thereby reducing of the temperature thereof and causing a reduction in NOX gases. As a side effect, since the secondary, or internal, flame causes a faster burning of the available fuel, the primary flame is shortened in length from what it would otherwise be.

While the present invention has been described in terms of a preferred embodiment, it will be apparent to those skilled in the art that various other embodiments and forms thereof can be employed without departing from the basic principles of the invention. For example, even though the tube is shown to have only one opening at its end, it can also have a number of openings along its length so as to thereby provide primary air at a number of locations within the fuel/air mixture. Also, while the air inlet tube is shown and described as extending along the extended axis of the burner, it need not be and could simply pass through the heat exchangers and extend radially inwardly into the flame area.

What is claimed is:

1. A NOX reduction apparatus for use in a furnace having a bummer for delivering a premixed fuel/air mixture to a combustion chamber comprising:

a conduit extending into a flame resulting from the ignition of said fuel/air mixture for introducing primary air into a central core portion of said flame to thereby affect the combustion process.

2. A NOX reduction apparatus as set forth in claim 1 wherein said conduit extends axially downstream of an axis of said burner, said conduit being supplied with primary air at its one end and having a discharge opening at its other end.

3. A NOX reduction apparatus as set forth in claim 1 wherein said conduit has a substantially radially extending portion near said burner.

4. A NOX reduction apparatus as set forth in claim 1 wherein said conduit passes through said burner.

5. A NOX reduction apparatus as set forth in claim 2 and including a pump for supplying primary air to said conduit.

6. A NOX reduction apparatus set forth in claim 5 wherein said pump is driven by a motor which also drives an inducer.

7. A NOX reduction apparatus as set forth in claim 1 wherein the radial extent of said conduit is relatively small as compared with that of said flame.

8. A method of reducing NOX in a gas burner of the type used in conjunction with a combustion chamber of a heat exchanger and having an inlet opening for the introduction of a fuel/air mixture into said combustion chamber, comprising the step of:

introducing a source of primary air into a central core portion of a flame resulting from the ignition of said fuel/air mixture to thereby affect the combustion process.

9. A method as set forth in claim 8 wherein said primary air is introduced by way of a conduit extending into said central core portion of said flame.

10. A method as set forth in claim 9 wherein said conduit extends axially downstream of an axis of said bummer, said conduit being supplied with primary air at its one end and having a discharge opening at its other end.

11. A method as set forth in claim 9 wherein said conduit has a substantially radially extending portion near said burner.

12. A method as set forth in claim 9 wherein said conduit passes through said burner.

13. A method as set forth in claim 9 wherein radius of said conduit is relatively small as compared to that of said flame.

* * * * *